US006756869B2

(12) United States Patent
Takami et al.

(10) Patent No.: US 6,756,869 B2
(45) Date of Patent: Jun. 29, 2004

(54) HOUSING FOR PLURAL RELAY SWITCHES

(75) Inventors: Koji Takami, Kyoto (JP); Yasuyuki Masui, Kyoto (JP); Masayuki Noda, Kyoto (JP); Takashi Suzuki, Kyoto (JP); Toshihiko Seki, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/789,512

(22) Filed: Feb. 22, 2001

(65) Prior Publication Data

US 2002/0023768 A1 Feb. 28, 2002

(30) Foreign Application Priority Data

Feb. 22, 2000 (JP) ..... 2000-043834

(51) Int. Cl.[7] ..... H01H 9/00
(52) U.S. Cl. ..... 335/162; 429/99; 439/718
(58) Field of Search ..... 335/152, 159–162, 335/202, 132–136; 361/819; 200/187, 188, 307; 439/627, 718; 429/99; 174/50.51

(56) References Cited

U.S. PATENT DOCUMENTS 1,343,880 A * 6/1920 Beck ..... 335/162
2,312,902 A * 3/1943 Hickman et al. ..... 335/162
2,329,856 A * 9/1943 Salathe et al. ..... 429/99
3,174,009 A * 3/1965 Deeg ..... 335/162
3,538,481 A * 11/1970 Fernando ..... 335/152
3,701,062 A * 10/1972 Koga et al. ..... 335/135
3,789,332 A * 1/1974 Jameel et al. ..... 335/152
3,958,199 A * 5/1976 Seitz, Jr. et al.
4,144,431 A * 3/1979 Elenbaas ..... 335/162
4,223,370 A * 9/1980 Quere et al.
5,038,123 A * 8/1991 Brandon ..... 335/202
6,105,629 A * 8/2000 Bourgeaux et al. ..... 139/455

* cited by examiner

*Primary Examiner*—Neil Abrams
(74) *Attorney, Agent, or Firm*—Morrison & Foerster LLP

(57) ABSTRACT

The object of this invention is to provide a relay unit and a housing for that unit to be used when a number of relay switches are installed side by side in a circuit to switch a power supply circuit on and off. A number of compartments are provided in a case with an open top such that one relay fits into each compartment. The relays are placed into these compartments, and a cover is fitted onto the open top of the case. Slits are provided along the upper edge of the case and/or in the cover, through which the connectors attached to the terminals of the various relays can pass. The cover is placed on top of the case with the connectors attached to the terminals of the various relays running through the various slits. With this invention, a number of relay switches are put into a single package (housing), thus making the relays easier to handle. The package makes it easier to mount and wire multiple relay switches. Because the positions of the connectors are controlled by the slits in the case, the connectors cannot rotate if they receive an accidental impact. This prevents accidental short circuits.

6 Claims, 11 Drawing Sheets

10 ··· RELAY UNIT
11 ··· CASE
12 ··· COVER
18 ··· MOUNTING TAB x(1,2,3)··· RELAY
a,b ··· SWITCH TERMINAL
20(a,b,c,d) BUS BAR

10 ··· RELAY UNIT
11 ··· CASE
12 ··· COVER
18 ··· MOUNTING TAB

10 ··· RELAY UNIT
11 ··· CASE
12 ··· COVER
18 ··· MOUNTING TAB x(1,2,3)··· RELAY
a,b ··· SWITCH TERMINAL
20(a,b,c,d) BUS BAR

11 ··· CASE
18 ··· MOUNTING TAB
X(1,2,3) ··· RELAY
a,b ··· TERMINALS
20(a,b,c,d) ··· BUS BAR

11 ··· CASE
14 ··· COMPARTMENT
18 ··· MOUNTING TAB
21 ··· CUT OUT SECTION
15 OPENING

12 ··· COVER
28 ··· CUT OUT PORTION

11 ··· CASE

11 ··· CASE

10 ··· RELAY UNIT
11 ··· CASE
12 ··· COVER
18 ··· TAB

10 ··· RELAY UNIT
11 ··· CASE
12 ··· COVER
18 ··· TAB

10 ··· RELAY UNIT
11 ··· CASE
12 ··· COVER
18 ··· TAB
X(1,2) ··· RELAY
20(a,b) ··· BUS BAR

HOUSING FOR PLURAL RELAY SWITCHES

FIELD OF THE INVENTION

This invention concerns a relay unit used to make or break a power supply circuit. More particularly, this invention relates to a relay unit and a housing unit which combines a number of relay switches in a single package in which a number of relay switches are combined in a single package, and the housing used in the relay unit for the packaging.

BACKGROUND OF THE INVENTION

In many electrical automobiles the motor, which runs the automobile, is driven by a power supply consisting of a built-in battery. A power supply circuit is actuated by a relay switch which turns the power supply on and off.

Such a power supply circuit is shown in FIG. 11. The DC power of battery E is converted to AC power by inverter IN to drive motor M. In front of inverter IN are capacitor C and resistor R, which constitute a charging circuit.

Relay switch X1 turns the positive electrode on and off. Relay switch X2 turns the positive electrode of charging circuit CR on and off. Relay switch X3 turns the negative electrode on and off. (Since both the positive and negative sides of the power supply can be switched on and off, it would be possible to switch both or to switch only the positive side. If only the positive side is switched, the third relay switch, X3, can be omitted.)

To drive motor M, relay switches X2 and X3 are turned on to charge charging circuit CR. When capacitor C is fully or almost fully charged, motor M is driven by turning relay switch X1 on, and relay switch X2 off.

If relay switches X1, X2 and X3 are all used, each is mounted separately in a fitting such as a relay mounting platform. However, mounting two or three relay switches individually is a difficult task, and the wiring can be extremely troublesome.

When two or three relay switches are to be installed side by side, since the same type of switch is used for all three, the connector terminals will all be at the same height. If their wiring is connected by a bus bar tightened down by a screw, an accidental shock can rotate the bar and cause adjacent connections to short.

SUMMARY OF THE INVENTION

The object of this invention is to provide a relay unit and a housing for the unit to be used when a number of relay switches are installed side by side in order to switch a power supply circuit on and off. Such a relay unit would be easy to install and wire, and would prevent accidental short circuits from occurring.

This invention is a relay unit to switch a power supply circuit which comprises the following. A number of compartments are provided in a case with an open top such that one relay fits into each compartment. The relays are placed into these compartments, and a cover is fitted onto the open top of the case. Slits are provided along the upper edge of the case and/or in the cover, through which the connectors attached to the terminals of the various relays can pass. The cover is placed on top of the case with the connectors attached to the terminals of the various relays running through the various slits. On the sides of the exterior of the case mounting, slits are provided through which the case can be fastened to its mounting location.

The relays are relay switches. They may be of the sealed or open type. A number of slits formed by the cut out portion are provided for the connectors to guide out. These slits may be positioned along the upper edge of the case, in the cover, or extending from the case to the cover, or some of them may be in the case and others in the cover.

This configuration serves to improve the isolation by ensuring that the edges of adjacent connectors are separated by a given distance. Because the connectors are fed out through the slits, they cannot be rotated. This configuration thus prevents shorting between adjacent connectors when the relay experiences an accidental impact from the exterior.

Placing one of the mounting slits on the bottom of the case allows the relay to be mounted vertically; placing one of the slits on the side of the case allows it to be mounted sideways. Mounting the relay sideways can be an effective way to use a space requiring a low-height component.

In a preferred embodiment of this invention, the common connector terminal for the relays in the case can be wired inside the unit. This will simplify the wiring that must be done on site.

In a preferred embodiment of this invention, the interior of the unit can be filled with insulating resin. In addition to improving the isolation, this will allow the heat generated by the relays to be transmitted to the case and the cover, where it can be radiated effectively via the large surface area.

The housing according to this invention is distinguished by the following. It encloses a relay unit for switching a power supply circuit. It has a case with an open top, which is provided with a plurality of compartments to enclose a plurality of relays, and a cover to be fitted onto the open top of the case. A plurality of cut out portions are provided on at least one upper edge of the case and lower edge of the cover. Through the cut out portion, a plurality of connectors are connected to terminals on relays enclosed in the compartments to guide out from the case when the case is enclosed by the cover. It also has a mounting tab provided on an outer surface of the case for fixing the relay unit.

This design produces a relay unit housing whose isolation is improved by the fact that the edges of adjacent connectors are separated by a given distance. Because the connectors are fed out through the slits, adjacent connectors will not short out when the relay experiences an accidental impact from the exterior.

According to this invention, a number of relay switches are put into a single package (housing), thus making the relays easier to handle. The package makes it easier to mount and wire multiple relay switches. Because the positions of the connectors are controlled by the slits in the case, the connectors cannot rotate if they receive an accidental impact. This prevents accidental short circuits. The case and the cover protect the contacts of the relays' connectors from water.

DETAILED DESCRIPTION OF THE INVENTION

Several preferred embodiments of this invention are explained with reference to the drawings.

Figure 11:
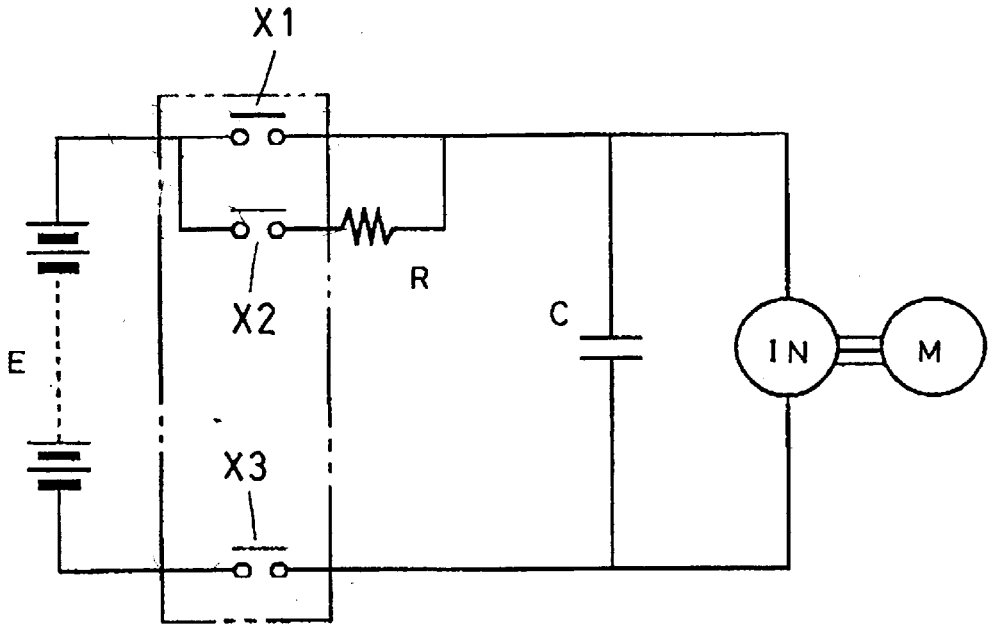
FIG. 11 is an electric diagram of the relay unit.

The drawings disclose a relay unit shown in FIG. 11 for switching a power supply circuit mentioned above. In FIGS. 1 through 5, relay unit 10 consists of case 11, with a base made from a specified composite resin and an open top; three relay switches, X1, X2 and X3 (hereafter called simply "the relays"), which fit into the case; and cover 12, formed from a specified composite resin which encloses the top of case 11. Case 11 and cover 12 form a housing for this relay unit. The relay unit thus consists of a vertical package (since case 11 is to be installed vertically). It would also be possible to have the partitions 13 extend downward from the corresponding places on the inside of cover 12.

Figure 4:
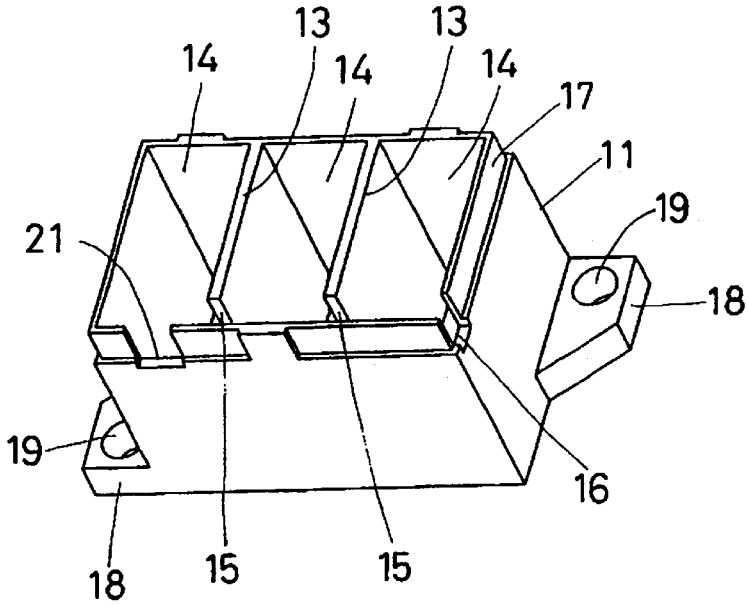
FIG. 4 is a perspective view of the case.

As can be seen in FIG. 4, there are two partitions 13 inside the case 11 which are the same height as the edge of the case. Partitions 13 create three compartments 14 in which relays X1 through X3 will be enclosed. On one end of the top of each of the partitions 13 there is an opening 15. The lead wires of relays X2 and X3 (not pictured) are led through these openings. There is a corresponding opening 16 in case 11 which is lined up with openings 15. The lead wires connected to the coils of Relays X1 through X3 are led out through openings 15 and 16.

There is a recessed level on the top edge of case 11 which forms a surface against which cover 12 fits snugly. Mounting tabs 18 project on either end of case 11 at its base. Each tab 18 has a mounting hole 19 in it through which an appropriate mounting screw can be inserted to fasten the housing to a mounting location such as a mounting platform (not pictured).

Switch terminals (or connector terminals) a and b of relays X1 through X3, which are placed in compartments 14 of case 11, are on the upper surface of the relays. The wiring is attached to them by means of screws (not pictured).

Switch terminal a of relays X1 and X2 is a common termination. L-shaped bus bar (or connector) 20*a* is screwed on to guide the unused portions of the terminals to the exterior. Switch terminal b on the other end of relay X1 is used without connecting with the terminals.

One terminal of I-shaped bus bars (connectors) 20*b* and 20*c* is screwed to switch terminals b and a on the opposite end of relays X2 and X3 to guide the unused portions of the connectors to the exterior.

One end of bent bus bar (or connector) 20*d* is screwed to switch terminal b on the other end of relay X3 to guide its unused portion to the exterior. The unused lower bent portion of the aforementioned bus bar 20*d* projects to the exterior through cut out section 21 on the top edge of case 11. The portion of bus bar 20*d* which is bent in step-fashion has a mounting location at a different level than that of its neighboring bus bar, 20*b*. This is done to make the distance between their two surfaces greater than it would be if they were at the same level so as to improve the isolation.

There is a mounting hole 22 to connect the wiring on the unused end of each of the bus bars 20 (*a, b, c* and *d*). The terminal on the side which is wired is attached by a screw. The part in which the mounting hole 22 is drilled extends horizontally, but it would be equally acceptable for this part to be bent vertically. All the bus bars 20 (*a, b, c* and *d*) are made from a conductive metal (i.e., they are connectors).

Figure 1:
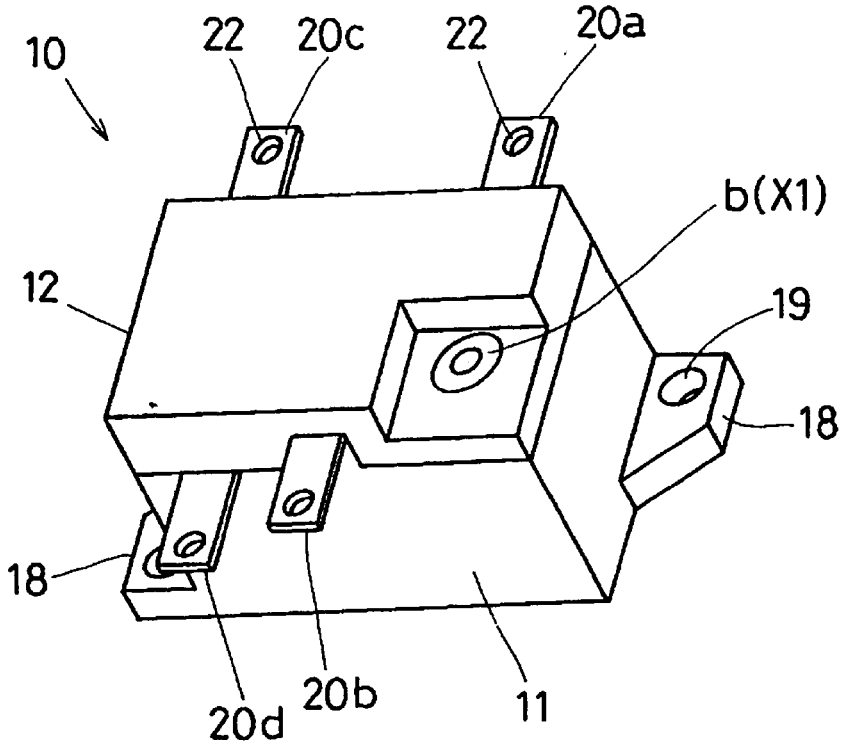
FIG. 1 is a perspective view of the relay unit according to a first preferred embodiment of this invention.
Figure 2:
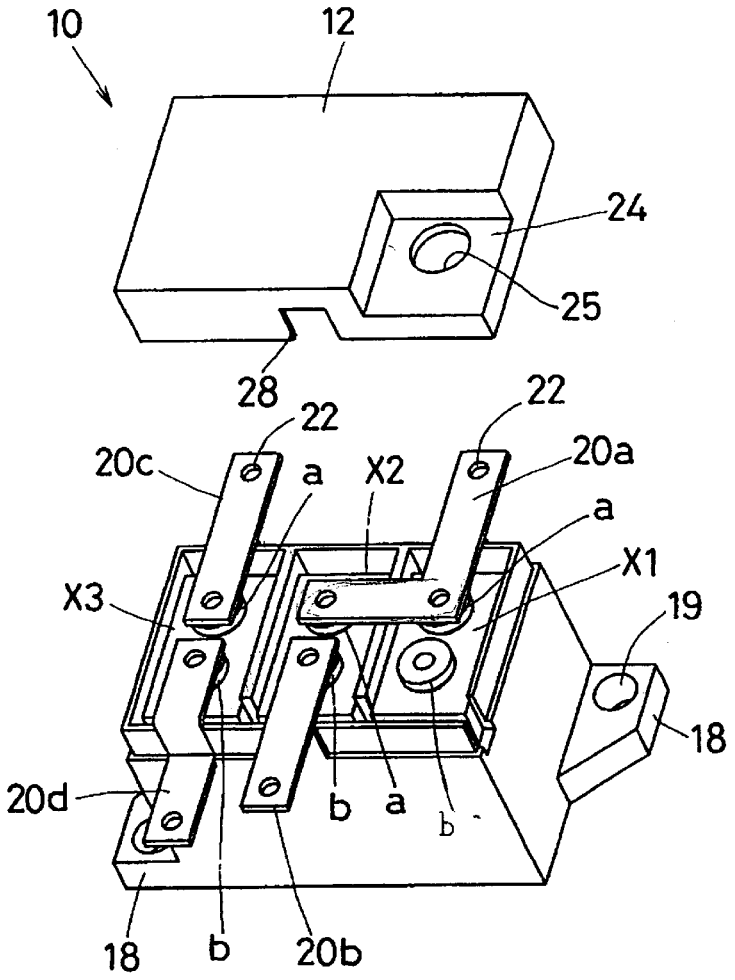
FIG. 2 is a perspective view of the relay unit when the cover is removed from the case.
Figure 3:
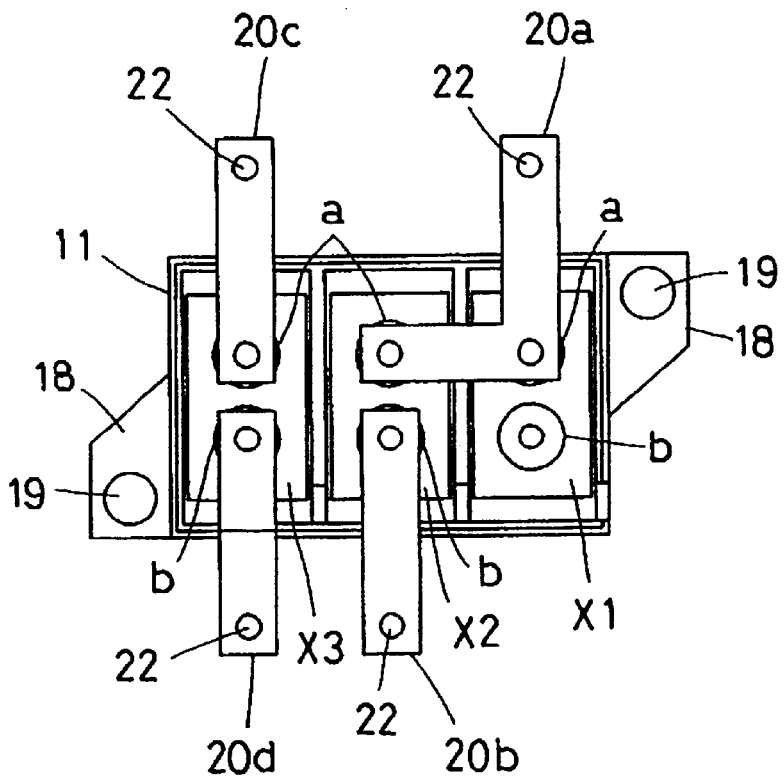
FIG. 3 is a top plan view of the case from the top.
Figure 5:
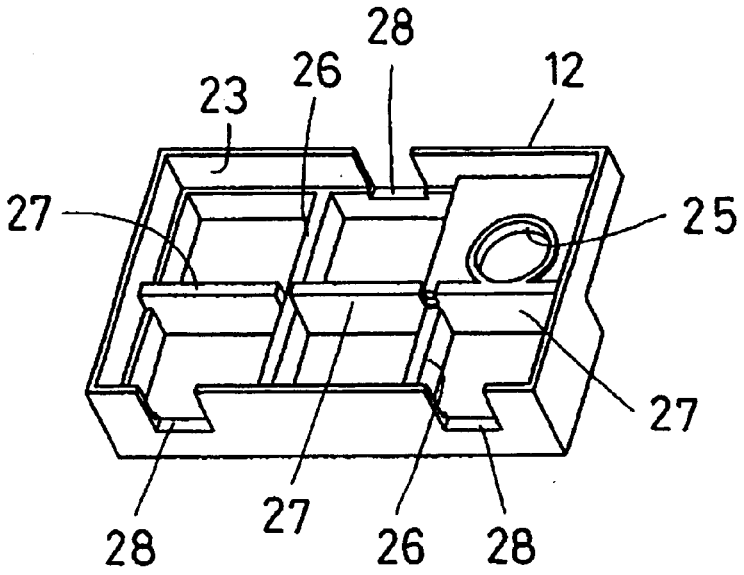
FIG. 5 is a perspective view of the inside of the cover.

The cover 12 is shown in FIG. 5. It has a ledge along its inner edge which serves as fitting 23, the portion of the cover which engages with fitting 17 on case 11. As can be seen in FIG. 2, the portion of the top of the cover which corresponds to switch terminal b on the other side of relay X1 consists of depression 24. There is a through hole 25 large enough for terminal b to fit through it in the location corresponding to the switch terminal b. The upper surface of the switch terminal b thus becomes coplanar with the surface of the cover. By creating two different levels via depression 24 and having switch terminal b exposed directly, we increase the isolation distance between switch terminal b and the edges of the adjacent bus bars 20*a* and 20*b*, thus increasing the degree of isolation.

To return to FIG. 5, there are two partitions 26 on the inside of cover 12 which correspond to the locations of partitions 13 in case 11. There is also an isolation wall 27 between switch terminals a and b of relays X1 through X3.

Three cut out sections 28 are provided in the locations which correspond to the bus bars 20*a*, 20*b* and 20*c*. Through the three cut out sections 28, these bus bars can extend out of the case.

We shall next explain how a relay unit 10 having the configuration described above would be assembled. Relays X1, X2 and X3 are placed into compartments 14 of the empty case 11 shown in FIG. 4. The appropriate bus bar 20 (*a, b, c* or *d*) is screwed to switch terminals a and b of relays X1 through X3, and cover 12 is fitted on top of the case 11. At this time surfaces 17 of the case and surface 23 of the cover are coated with adhesive and glued together.

When a relay unit 10 has been assembled in this way, it is ready for use; however, the isolation inside the case can be improved if compartments 14 inside the unit are filled with an insulating resin such as epoxy resin (not pictured) which can provide more isolation. The opening through which the insulating resin can be injected is not shown in the drawings. It may be placed in a convenient location on the bottom of case 11 or the top of cover 12.

If the case is filled with insulating resin, the resin will adhere to the inner surfaces of case 11 and cover 12, so there will be no need to use an adhesive to glue surfaces 17 and 23 of case 11 and cover 12 together.

When a relay unit 10 configured as described above is to be used, mounting tabs 18 on the base of the unit are placed on mounting platforms or some other sort of mounting stages and screwed down by inserting screws through mounting holes 19.

With this relay unit 10, relay X2, which actuates charging circuit CR (see FIG. 11), is only used to turn the power supply on. With this relatively infrequent use, relay X2 will not generate much heat. However, the two other relays, X1 and X3, which drive motor M, will have a high frequency of use and will produce a great deal of heat. Thus placing relay X2 between relays X1 and X3 will allow it to serve as a radiator, as it will be able to radiate the heat generated by relays X1 and X3, which are placed on either side of it.

Figure 6A:
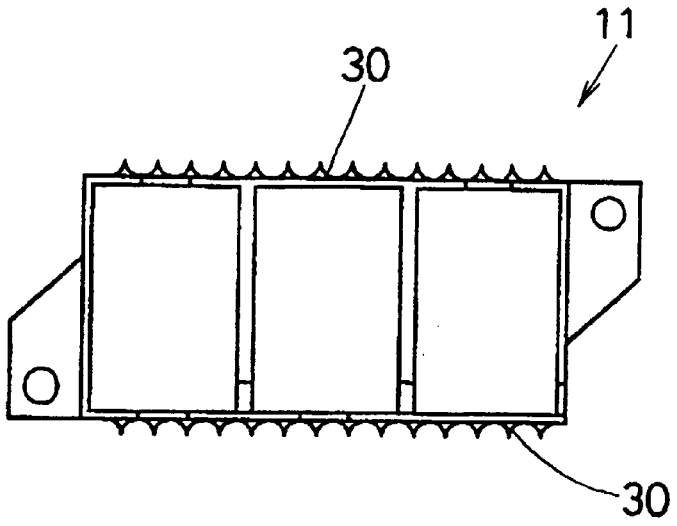
FIG. 6 (*a*) is a plane view of the relay unit according to a second preferred embodiment of this invention, and FIG. 6 (*b*) is a partial side view of the same.
Figure 6B:
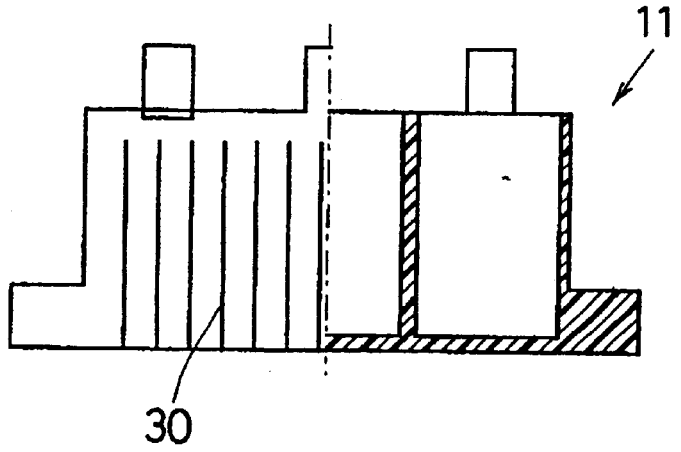

FIGS. 6*a* and 6*b* show a second preferred embodiment of structures to enhance the aforementioned radiation effect. It has a radiation structure 30 on the front and rear surfaces of case 11. These surfaces are made irregular in order to increase the surface area. Since all other structural elements of case 11 are identical to those shown in the first embodiment pictured in FIGS. 1 through 5, we will not give a detailed description of them here. Providing radiator elements 30 on the sides of the case simply enhances the radiation effect.

Figure 7A:
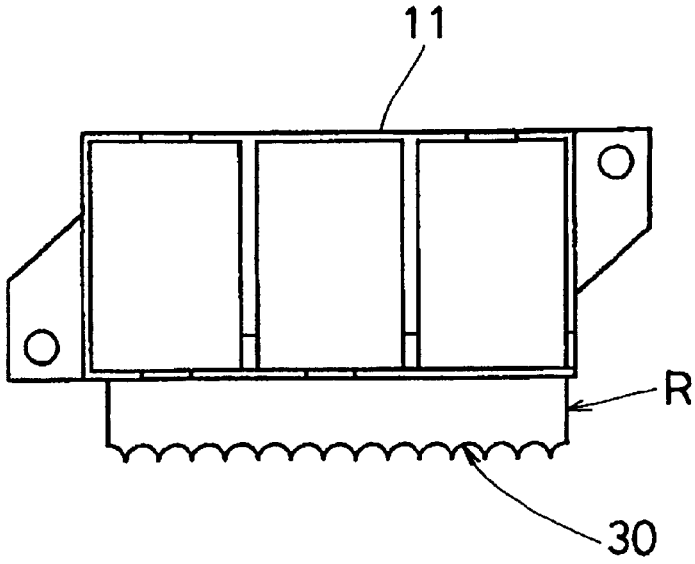
FIG. 7 (*a*) is a plane view of the relay unit according to a third preferred embodiment of this invention, and FIG. 7 (*b*) is a partial side view of the same.

FIGS. 7*a* and *b* show a third preferred embodiment to enhance the aforementioned radiation effect. A resistor R with a radiator element 30 consisting of an irregular surface with a large surface area is attached to the front surface of case 11. Since all other structural elements of case 11 are identical to those shown in the first embodiment pictured in FIGS. 1 through 5, we will not give a detailed description of them here. The resistor R is the resistor R of the charging circuit CR shown in FIG. 11. Since resistor R is used infrequently along with relay X2, it produces little heat. Resistor R can thus be used in place of a radiator panel to increase the radiation effect.

Figure 8:
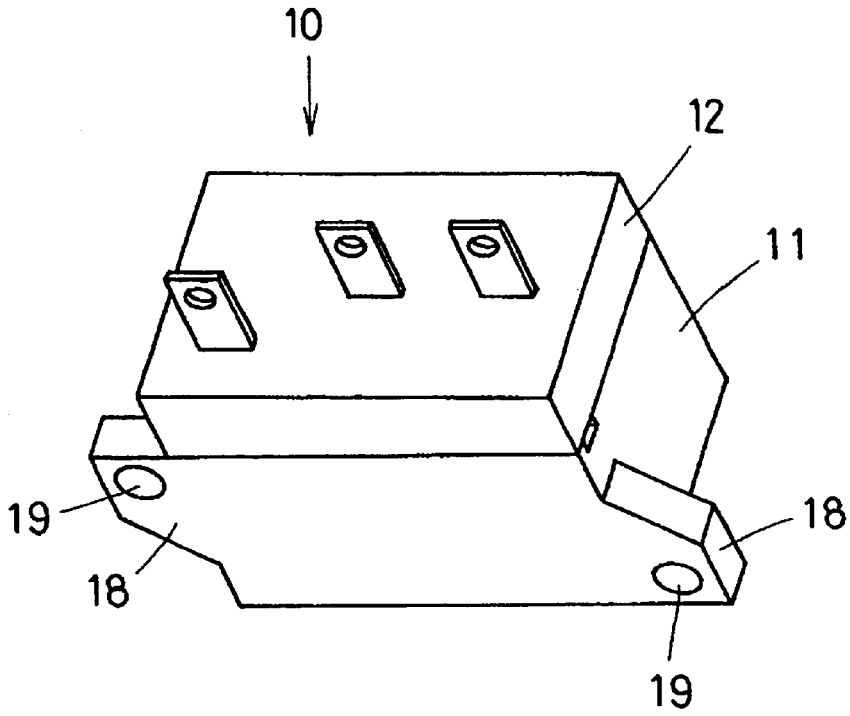
FIG. 8 is a perspective view of the relay unit according to a fourth preferred embodiment of this invention.
Figure 9:
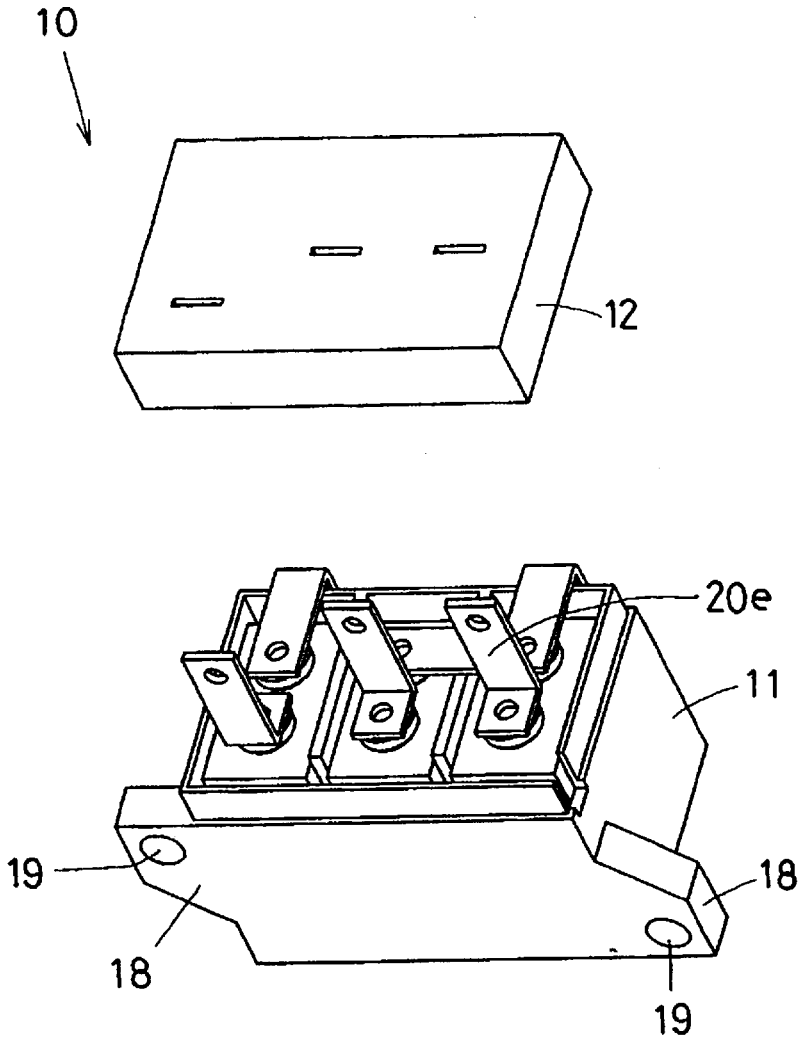
FIG. 9 is a perspective view of the relay unit shown in FIG. 8 when the cover is removed from the case.

FIGS. 8 and 9 shown a horizontal-type relay unit 10 (i.e., a unit used with case 11 oriented horizontally) according to a fourth preferred embodiment. Mounting tabs 18 extend in the vertical plane from opposite ends of a single vertical surface of case 11.

Since all other structural elements of case 11 are identical to those shown in the first embodiment shown in FIGS. 1 through 5, we will not give a detailed description of them here. However, in this example bus bar 20*e* is screwed to the other switch terminal b of relay X1. This horizontal-type relay is useful for locations requiring a component with a low profile.

In all of the embodiments discussed above, three relays X1, X2 and X3 are used. However, for a single-pole switching power supply circuit, relay X3 would be removed and relay X2 would be placed in its compartment instead. The middle compartment 14 could be left empty or filled with insulating resin.

Figure 10:
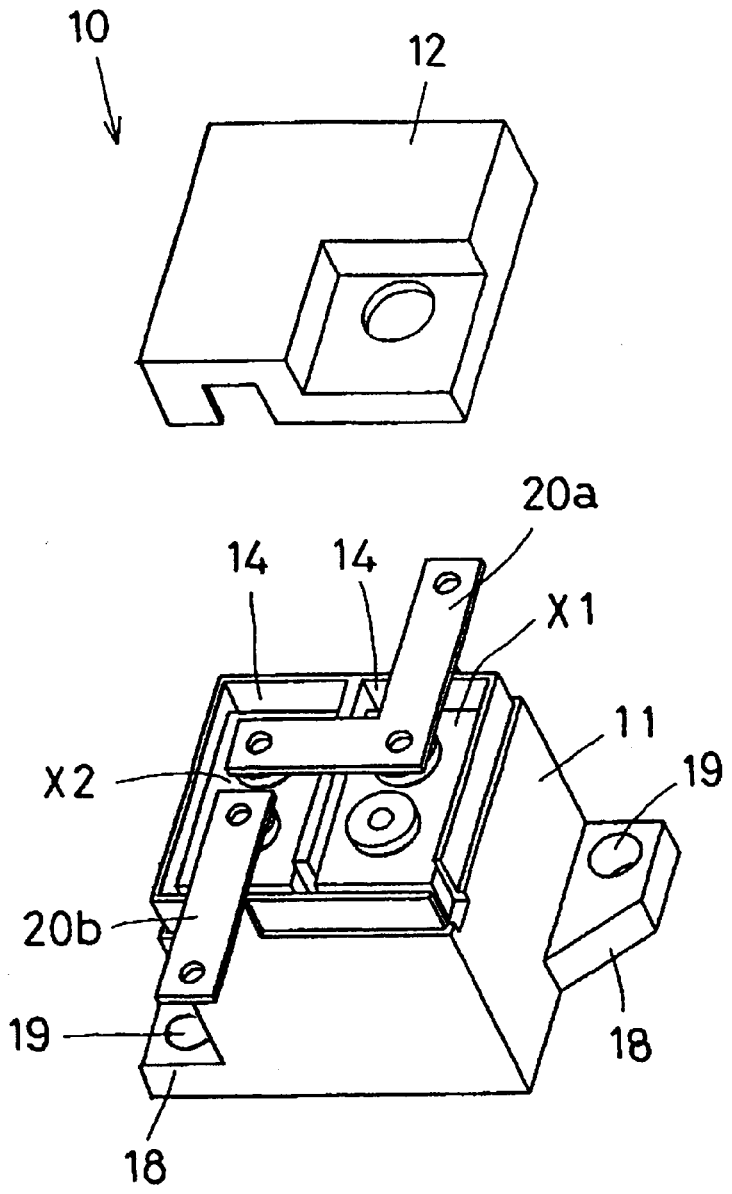
FIG. 10 is a perspective view of the relay unit according to a fifth preferred embodiment of this invention.

FIG. 10 shows a relay unit 10 in which there is a charging circuit in the power supply circuit and the power supply circuit has a single pole. Here there are only two compartments 14. Since all other structural elements of case 11 are identical to those of the relay unit 10, pictured in FIGS. 1 through 5, we will not give a detailed description of them here.

Figure 7B:
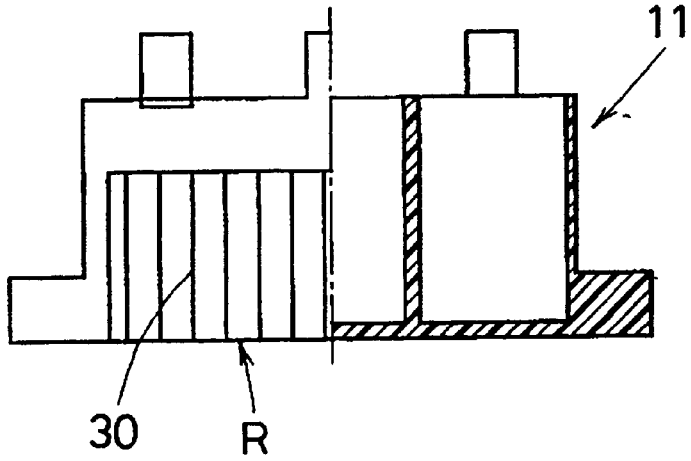

If only two relays, X1 and X2, are being used, only two compartments 14 are needed. It is, of course, acceptable for the front and rear surfaces of case 11 to be provided with radiator elements 30 as shown in FIG. 6, or to have a resistor R with a radiator element 30 attached to them as shown in FIG. 7. The horizontal configuration shown in FIG. 8 would also be a possible adaptation.

What is claimed is:

1. A relay unit for switching a power supply circuit, comprising:

a case with an open top, which is provided with said case having a plurality of compartments;

a plurality of relays enclosed in said plurality of compartments;

a cover to be fitted onto said open top of said case;

a plurality of cut out portions provided on at least one of an upper edge of said case and a lower edge of said cover, through which a plurality of connectors are connected to terminals of said relays enclosed in said compartments to guide out said connectors from said case when said case is enclosed by said cover, the connectors to be located between main bodies of the relays and a major wall of the cover; and a mounting tab provided on an outer surface of said case for fixing said relay unit.

2. A relay unit according to claim 1, wherein a plurality of common terminals of said plurality of relays are connected with a common connector in said relay unit.

3. A relay unit according to claim 1, wherein an interior of said relay unit is filled with insulating resin.

4. A relay unit according to claim 1, wherein one of said connectors is bent in step-fashion in order to have a mounting location at a different height level than another mounting location of a neighboring connector so as to improve an electrical isolation.

5. A relay unit according to claim 1, wherein said plurality of cut out portions fix said plurality of connectors.

6. A housing to enclose a relay unit for switching a power supply circuit, comprising;

a case with an open top, said case having a plurality of compartments to enclose a plurality of relays;

a cover to be fitted onto said open top of said case;

a plurality of cut out portions provided on at least one of an upper edge of said case and a lower edge of said cover, through which a plurality of connectors are connected to terminals of said relays enclosed in said compartments to guide out said connectors from said case when said case is enclosed by said cover, the connectors to be located between main bodies of the relays and a major wall of the cover; and a mounting tab provided on an outer surface of said case for fixing said relay unit.

* * * * *